US010212975B2

(12) United States Patent
Levindofske

(10) Patent No.: US 10,212,975 B2
(45) Date of Patent: Feb. 26, 2019

(54) METHODS AND SYSTEMS OF MARKING A GLOVE

(71) Applicant: Timothy Levindofske, West Seneca, NY (US)

(72) Inventor: Timothy Levindofske, West Seneca, NY (US)

( * ) Notice: Subject to any disclaimer, the term of this patent is extended or adjusted under 35 U.S.C. 154(b) by 0 days.

(21) Appl. No.: 15/534,168

(22) PCT Filed: Dec. 4, 2015

(86) PCT No.: PCT/US2015/063857

§ 371 (c)(1),
(2) Date: Jun. 8, 2017

(87) PCT Pub. No.: WO2016/111781

PCT Pub. Date: Jul. 14, 2016

(65) Prior Publication Data

US 2018/0184736 A1 Jul. 5, 2018

Related U.S. Application Data

(60) Provisional application No. 62/101,530, filed on Jan. 9, 2015.

(51) Int. Cl.

| | |
|---|---|
| ***A41D 19/015*** | (2006.01) |
| ***A41D 19/04*** | (2006.01) |
| ***A63B 71/14*** | (2006.01) |
| *A63B 71/06* | (2006.01) |

(52) U.S. Cl.

CPC ..... *A41D 19/01547* (2013.01); *A41D 19/04* (2013.01); *A63B 71/146* (2013.01); *A41D 2600/10* (2013.01); *A41D 2600/20* (2013.01); *A63B 2071/0694* (2013.01)

(58) Field of Classification Search

CPC ..... A63B 71/14; A63B 71/146; A63B 53/14; A41D 19/04; A41D 19/1547; A41D 2600/10; A41D 2600/20

USPC ..... 473/205, 19; 2/19, 161.1, 161.2

See application file for complete search history.

(56) References Cited

U.S. PATENT DOCUMENTS

| | | | | |
|---|---|---|---|---|
| 5,878,659 | A * | 3/1999 | Hatter | A63B 45/02 101/35 |
| 6,272,686 | B1 | 8/2001 | Liu | |
| 6,974,395 | B1 | 12/2005 | Rioux et al. | |
| 2001/0053721 | A1* | 12/2001 | Tyke | A63B 43/008 473/257 |
| 2004/0107476 | A1 | 6/2004 | Goldwitz | |
| 2008/0271334 | A1* | 11/2008 | Sung | A63B 45/02 33/562 |
| 2011/0263346 | A1* | 10/2011 | Wise | A63B 53/14 473/205 |

* cited by examiner

*Primary Examiner* — Mark S Graham
*Assistant Examiner* — Rayshun K Peng
(74) *Attorney, Agent, or Firm* — Hodgson Russ LLP

(57) ABSTRACT

Methods and systems of marking a glove. The method can include providing a glove having first and second markings. The glove can be inserted into a receiving cavity of a housing, the receiving cavity defined by a front face and a rear face of the housing. The first and second markings on the glove can be aligned with an alignment indicator on the front face of the housing when the glove is in the receiving cavity. The glove can be marked through a first marking aperture disposed through the front face of the housing with a writing instrument.

20 Claims, 4 Drawing Sheets

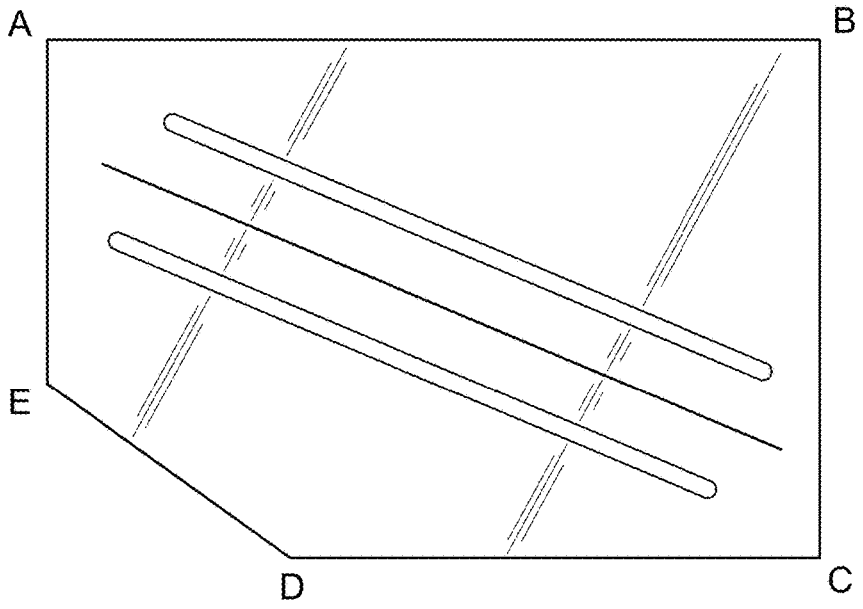
FIG. 8
FIG. 9
FIG. 10
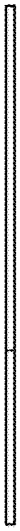
FIG. 11
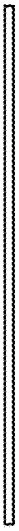
FIG. 12

METHODS AND SYSTEMS OF MARKING A GLOVE

CROSS-REFERENCE TO RELATED APPLICATIONS

This application claims priority to U.S. Provisional Application No. 62/101,530 filed on Jan. 9, 2015, the disclosure of which is incorporated herein by reference in its entirety.

FIELD OF THE DISCLOSURE

The present disclosure relates generally to methods and systems of marking a glove.

BACKGROUND OF THE DISCLOSURE

A proper grip is desirable when wielding hand-held objects. For instance, many sports require a player to grip a handle or shaft on a piece of sporting equipment. Golfers, in particular, strive for a consistent grip of a golf club to improve accuracy and consistency. Proper grip of sporting equipment can also be important in other sports, such as, tennis, football, hockey, and cycling. Grip alignment can also be important when wielding hand-held tools equipped with a handle or shaft, such as hammers and axes.

In order to improve grip, some manufacturers offer specialized sporting gloves having printed or sewn grip guides on the glove surface. However, many of these gloves suffer from several deficiencies, such as: (1) carrying a premium price, despite being of inferior quality or feel; (2) not being in compliance with R&A and USGA regulations; and (3) being manufactured in generic sizes, which cannot account for a particular user's hand size and shape. Furthermore, users often have a preference for a particular type of glove that does not have a prefabricated grip guide.

Therefore, there is a need for a low-cost solution for providing a customizable and more accurate grip guide on sporting gloves. There is also a need for users to be able to apply a grip guide to gloves of the user's choice.

SUMMARY OF THE DISCLOSURE

The present disclosure can be embodied as a method of marking a glove. The method can include providing a glove having first and second markings. The glove can be inserted into a receiving cavity of a housing, the receiving cavity defined by a front face and a rear face of the housing. The first and second markings on the glove can be aligned with an alignment indicator on the front face of the housing when the glove is in the receiving cavity. The glove can be marked through a first marking aperture disposed through the front face of the housing with a writing instrument.

According to another embodiment of the present disclosure, a glove marking system is described. The system can include a glove and a housing. The housing can have a front face and a rear face. The front face may include an alignment indicator and a first marking aperture. The first marking aperture can be disposed through the front face. The front face and rear face can define a glove receiving cavity configured to receive the glove. The alignment indicator may be configured to align the glove in an alignment position corresponding to the glove being positioned in the glove receiving cavity to mark the glove through the first marking aperture.

DESCRIPTION OF THE DRAWINGS

For a fuller understanding of the nature and objects of the disclosure, reference should be made to the following detailed description taken in conjunction with the accompanying drawings, in which:

FIG. 8 is a front view of the housing;

FIG. 9 is a top view of the housing;

FIG. 10 is a bottom view of the housing;

FIG. 11 is left view of the housing; and

FIG. 12 is a right view of the housing.

DETAILED DESCRIPTION OF THE DISCLOSURE

Figure 1:
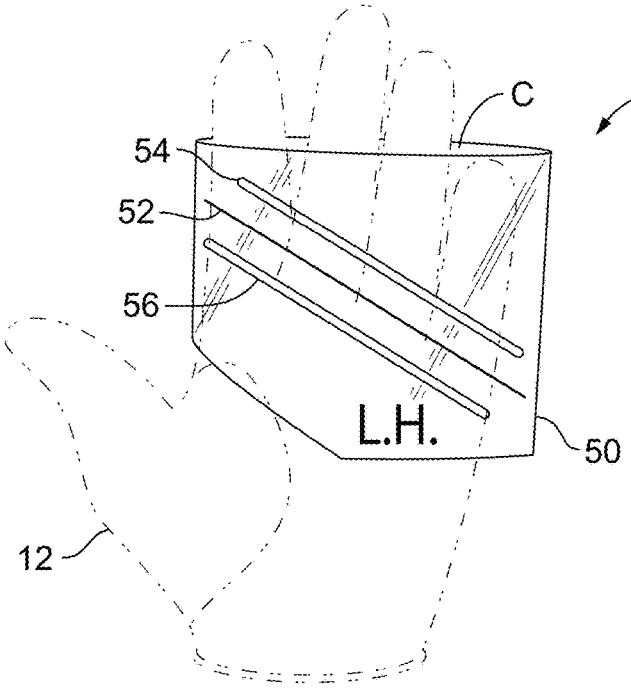
FIG. 1 depicts a housing according to an embodiment of the disclosure, the housing being positioned over an exemplary glove.
Figure 2:
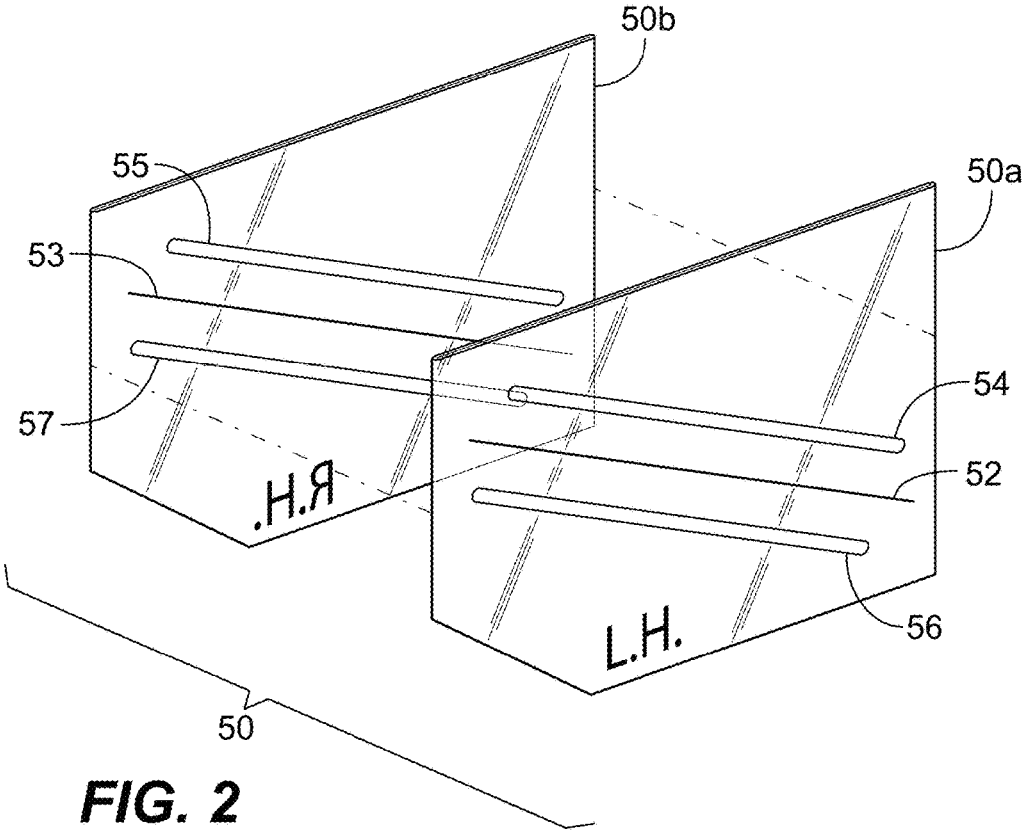
FIG. 2 is an exploded view of the housing.

FIGS. 1-2 depict a system 10 according to an embodiment of the disclosure. The system includes a glove 12 and a housing 50. The housing 50 can include a front face 50*a* and a rear face 50*b*. The front face 50*a* can include an alignment indicator 52, a first marking aperture 54, and a second marking aperture 56. The rear face 50*b* can also include an alignment indicator 53, a first marking aperture 55, and a second marking aperture 57. The first marking apertures 54, 55 and the second marking apertures 56, 57 can be disposed through the respective front face 50*a* and rear face 50*b* of the housing 50.

The housing 50 can define a receiving cavity C. For example, the receiving cavity C can be defined by the front face 50*a* and rear face 50*b*. In order to define the receiving cavity C, the front face 50*a* and rear face 50*b* can be joined together, for example, via heat lamination, adhesive, fastener, or other joining member. In other embodiments, the front face 50*a* and rear face 50*b* may be one, continuous piece of material. Although the front face 50*a* and rear face 50*b* are shown as being joined together at respective side edges (e.g. in FIG. 1), it is possible for the front face 50*a* and rear face 50*b* to be joined at alternative, or additional location(s) to define a receiving cavity C.

The housing 50 may be made completely of, or at least partially of, a non-opaque material to allow a user to see at least a portion of the glove 12 through the housing 50 when the glove is positioned in the receiving cavity C. For example, some, or all, of the housing 50 can be made from a clear, thin material, such as a translucent or partially translucent plastic. The housing 50 can be generally rectangular, as depicted in the drawings, and include a truncated corner 58. The cavity C may be sized such that it creates a relatively snug, frictional fit, about a user's hand and glove 12. In this manner, the housing 50 can be generally maintained in a stationary position relative to the user's hand and glove 12 on its own—for example, without the user having to user their other hand to maintain a stationary position between glove 12 and housing 50.

The alignment indicators 52, 53 on the housing 50 may be markings drawn on the front face 50*a* and rear face 50*b* of the housing. As shown in the figures, an alignment indicator 52, 53 can be a straight line along at least a portion of the housing 50. However, the alignment indicator can include a plurality of markings and shapes. The first marking apertures 54, 55 may be offset relative to their respective alignment indicators 52, 53 by a distance by a first distance. The second marking apertures 56, 57 may be offset relative to their respective alignment indicators 52, 53 by a second distance. The first distance and second distance may be equal, or unequal depending on the particular application. The alignment indicator 52, first marking aperture 54, and second marking aperture 56 of the front face 50*a* can be mirror symmetrical to the alignment indicator 53, first marking aperture 55, and second marking aperture 57 of the rear face 50*b*, with respect to an imaginary plane through the center of the receiving cavity C, the imaginary plane being generally parallel to the front face 50*a* and rear face 50*b*.

FIGS. 3-7 depict how the system 10 may be used in practice. For example, the system 10 may be used to provide one or more markings M1, M2 on a sports glove 12. In particular, the markings M1, M2 may be used to indicate a preferred sports grip to a user—such as a golf club grip.

Figure 3:
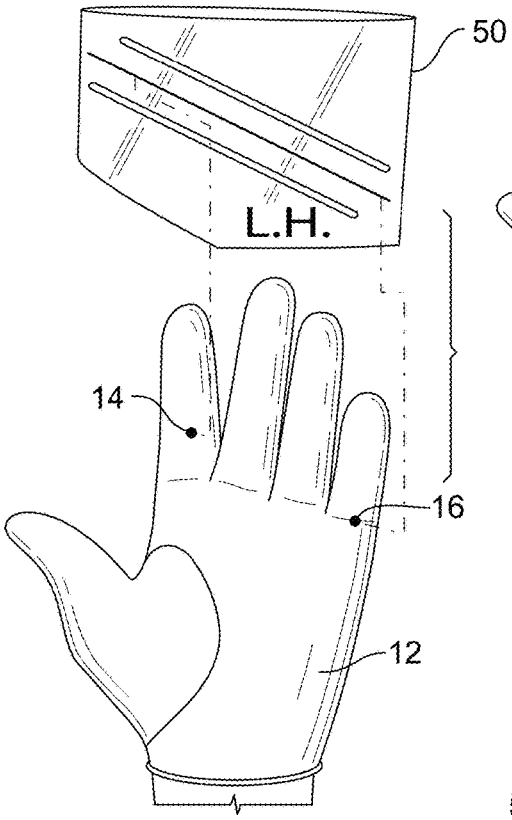
FIG. 3 shows the housing being aligned with a glove for use.

FIG. 3 shows the glove 12 spaced apart from the housing 50. The glove 12 can be marked with a first marking 14 and second marking 16. A user of the system 10 can mark the glove with first and second markings 14, 16, or the glove 12 may come from a manufacturer having prefabricated with markings 14, 16. In the example provided in the figures, the first marking 14 may be positioned on the inside (i.e. palm-side) of the user's index finger's middle knuckle and the second marking 16 may be positioned at the inside (i.e. palm-side) location of where the user's pinky finger meets the palm. However, other locations of the first and second markings 14, 16 may be additionally and/or alternatively used to align the housing 50 relative to the glove 12 to provide markings as described in further detail below.

Figure 4:
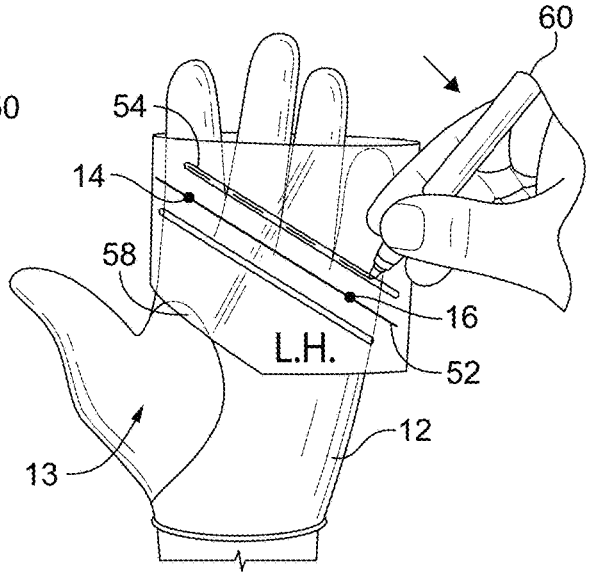
FIGS. 4-5 shows a user marking the glove with the housing be in an aligned position.
Figure 5:
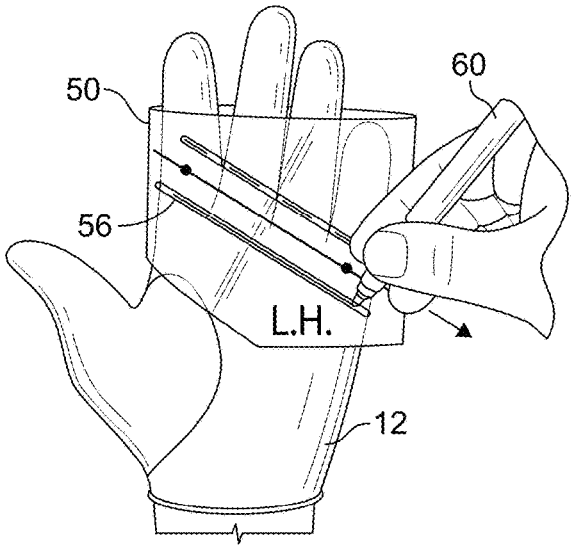

As shown in FIGS. 4-5, a user can insert the glove 12 into the receiving cavity C of the housing 50 to place the glove in an "aligned position." Specifically, the glove 12 can be positioned in the cavity C such that the first and second markings 14, 16 are aligned with the alignment indicator 52. In order to facilitate alignment of the glove 12 relative to the housing 50, the glove must be viewable through the alignment indicator 52. This can be achieved by one or more portions, or the entirety, of the housing being translucent 50. In another embodiment, the alignment indicator 52 may be an aperture to allow the markings 14, 16 on the glove 50 be viewable therethrough. In the aligned position, a thumb portion 13 of the glove 12 may be positioned outside of the glove 12, adjacent to truncated corner 58 of housing 50. Consequently, the truncated corner 58 can be helpful in allowing a single housing 50 to accommodate a wide range of glove 12 sizes.

In the aligned position, the glove 12 may be ready to be marked by a user. For example, FIG. 4 shows the user marking the glove 12 with a writing instrument 60, such as a felt-tip marker pen, through the first marking aperture 54. FIG. 5 shows the glove subsequently marking the glove 12 through second marking aperture 56.

Figure 6:
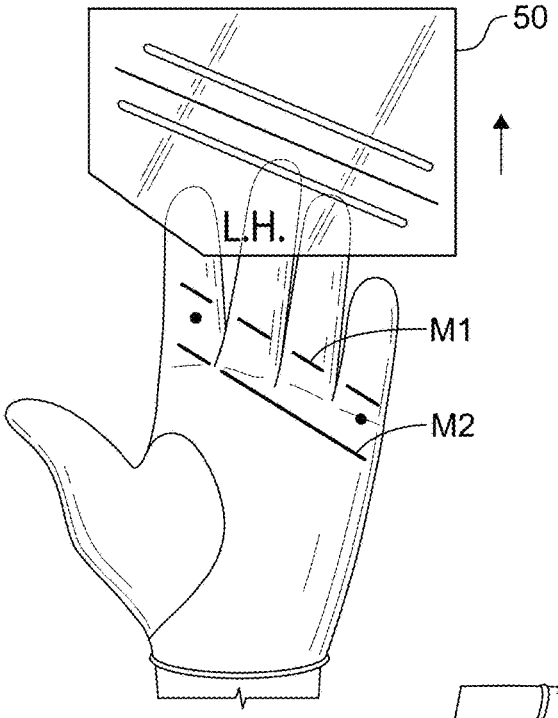
FIG. 6 depicts the housing being removed from a marked glove.
Figure 7:
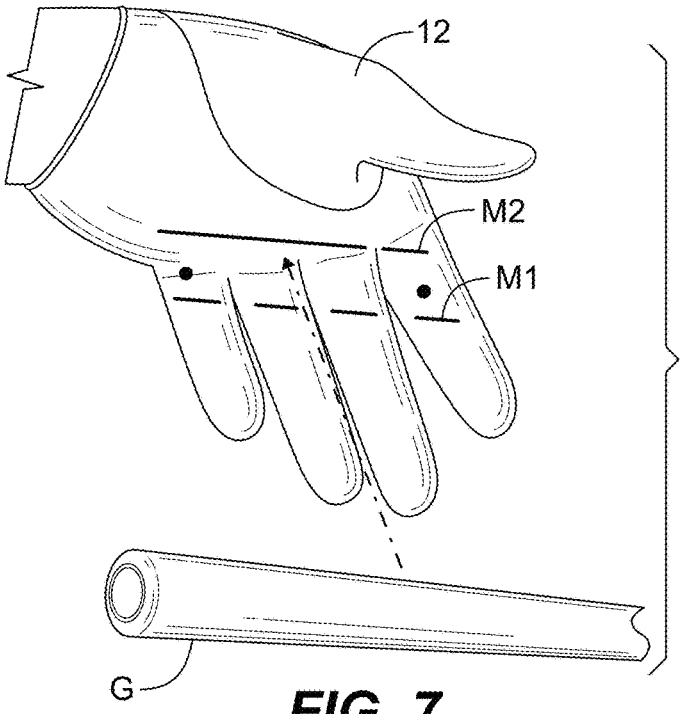
FIG. 7 depicts a user aligning a golf club with the marked glove.

With reference to FIG. 6, the housing 50 can be moved away from the glove 12 after the user has completed marking the glove. As can be seen, first marking M1 and second marking M2 are present on the glove. FIG. 7 shows an example of a marked glove 12 in use. Specifically, the first marking M1 and second marking M2 may be used to align the glove 12 (and thereby the user's hand) relative to sports equipment, such as a golf grip G. In one embodiment, the first marking M1 and second marking M2 are offset relative to one another by a distance that is approximately equal to a diameter of a golf grip. For example, the markings M1, M2 may be offset relative to one another such that the width of a golf grip G fits between the markings M1, M2.

As described, the markings may be directed to holding a golf club in the proper position in the hand. This can correspond to the golf club laying across the base of the fingers rather than in the palm of the hand. It is often found that a user may inadvertently reposition the golf club during prolonged use. Therefore, the markings can provide a simple and quick review of the user's grip of a golf club.

It should be appreciated that other configurations of the housing 50 are possible without deviating from the scope of the present application. For example, a housing 50 can be made to leave various different shapes of markings on a glove by varying the shape, size, and/or location of one or more marking apertures. It is also contemplated that the housing 50 may include only a single marking aperture for making a glove—or include several marking apertures. The one or more marking apertures may also serve as both an alignment indicator for positioning the glove into the alignment position and to receive a marking instrument for making the glove with grip markings. In this manner, the housing 50 may be used in a variety of sporting applications. It is also contemplated that the housing 50 may only include a single face, and not include a cavity, but still be used in a substantially similar manner as described above.

FIGS. 8-12 provide additional views of the housing 50 shown in FIGS. 1-6. Specifically, FIG. 8 is a front view of the housing 50; FIG. 9 is a top view of the housing 50; FIG. 10 is a bottom view of the housing 50; FIG. 11 is left view of the housing 50; and FIG. 12 is a right view of the housing. With reference to FIG. 8, the housing 50 may be approximately 5 inches wide (i.e. distance between corners A and B) by 3.75 inches tall (i.e. distance between corners B and C). The distance between corners A and E may be approximately 2.4 inches and the distance between corners C and D can be approximately 2.6 inches.

As will be appreciated, the present disclosure can be embodied as a method. The method can include providing a glove having first and second markings. The glove can be inserted into a receiving cavity of a housing, the receiving cavity defined by a front face and a rear face of the housing. The first and second markings on the glove can be aligned with an alignment indicator on the front face of the housing when the glove is in the receiving cavity. The glove can be marked through a first marking aperture disposed through the front face of the housing with a writing instrument.

Although the present disclosure has been described with respect to one or more particular embodiments, it will be understood that other embodiments of the present disclosure may be made without departing from the spirit and scope of the present disclosure. The following are sample claims and are not intending to be limiting.

What is claimed is:

1. A method of marking a glove, comprising:

providing a glove having first and second markings;

inserting the glove into a receiving cavity of a housing, the receiving cavity defined by a front face and a rear face of the housing joined at respective side edges;

aligning the first and second markings on the glove with an alignment indicator on the front face of the housing when the glove is in the receiving cavity;

marking the glove through a first marking aperture disposed through the front face of the housing with a writing instrument;

wherein the front face of the housing and the rear face of the housing are one or more planar sheets of material, which are flexible from an initial rest position to an open position for receiving the glove in the receiving cavity.

2. The method of marking of claim 1, wherein the first marking aperture is offset a first distance relative to the alignment indicator.

3. The method of marking of claim 1, further comprising marking the first and second markings on the glove with the writing instrument.

4. The method of marking of claim 1, further comprising marking the glove through a second making aperture disposed through the front face of the housing with a writing instrument.

5. The method of marking of claim 4, wherein the second marking aperture is offset a second distance relative to the alignment indicator.

6. The method of marking of claim 5, wherein the first marking aperture is offset relative to the alignment indicator by a first distance relative to the alignment indicator.

7. The method of marking of claim 6, wherein the first distance is equal to the second distance.

8. The method of marking of 6, wherein the sum of the first distance and the second distance is approximately equal to a diameter of a golf grip.

9. The method of marking of claim 1, wherein the alignment indicator is the first marking aperture.

10. The method of claim 1, wherein the alignment indicator is a marking on the front face.

11. The method of claim 1, wherein the housing includes a truncated corner; and wherein a thumb portion of the glove is disposed outside of the housing when the first and second markings are aligned with the alignment indicator when the glove is in the receiving cavity.

12. The method of marking a glove of claim 1, wherein the housing includes a rear alignment indicator and a first rear marking aperture on the rear face of the housing, the rear alignment indicator and the first rear marking aperture being mirror symmetrical to the alignment indictor and the first marking aperture on the front face of the housing.

13. A glove marking system, comprising:

a glove;

a housing including a front face and a rear face joined at respective side edges, the front face including an alignment indicator and a first marking aperture, the first marking aperture being disposed through the front face;

wherein the front face and rear face define a glove receiving cavity configured to receive the glove;

wherein the alignment indicator is configured to align the glove in an alignment position corresponding to the glove being positioned in the glove receiving cavity to mark the glove through the first marking aperture;

wherein the front face of the housing and the rear face of the housing are one or more planar sheets of material, which are deformable from an initial rest position to an open position for receiving the glove in the receiving cavity.

14. The glove marking system of claim 13, wherein the glove includes first and second markings, the first marking and the second marking being positioned on the glove to align with the alignment indicator for indicating that the glove is positioned in the alignment position.

15. The glove marking system of claim 13, wherein at least a portion of the housing is non-opaque such that a portion of the glove is visible through the housing.

16. The glove marking system of claim 13, further comprising a second marking aperture being disposed through the front face.

17. The glove marking system of claim 16, wherein the first marking aperture is offset relative to the alignment indicator by a first distance relative to the alignment indicator; and wherein the second marking aperture is offset relative to the alignment indicator by a second distance relative to the alignment indicator.

18. The glove marking system of claim 17, wherein the first distance is equal to the second distance, the sum of the first distance and the second distance being approximately equal to a diameter of a golf grip.

19. The glove marking system of claim 13, wherein the housing includes a truncated corner, the truncated corned being positioned such that a thumb portion of the glove is disposed outside of the housing when the glove is in alignment position.

20. The method of marking a glove of claim 13, wherein the housing includes a rear alignment indicator and a first rear marking aperture on the rear face of the housing, the rear alignment indicator and the first rear marking aperture being mirror symmetrical to the alignment indictor and the first marking aperture on the front face of the housing.

* * * * *